US006513586B1

(12) United States Patent
Haussmann

(10) Patent No.: US 6,513,586 B1
(45) Date of Patent: Feb. 4, 2003

(54) FLAT TUBE OF A HEAT EXCHANGER IN HEATING INSTALLATIONS OR OF A RADIATOR OF A MOTOR VEHICLE

(75) Inventor: Roland Haussmann, Wiesloch (DE)

(73) Assignee: Valeo Klimatechnik GmbH & Co., KG (DE)

( * ) Notice: Subject to any disclaimer, the term of this patent is extended or adjusted under 35 U.S.C. 154(b) by 0 days.

(21) Appl. No.: 09/300,108

(22) Filed: Apr. 27, 1999

(30) Foreign Application Priority Data

Apr. 29, 1998 (DE) ..... 198 19 248

(51) Int. Cl.[7] ..... F28F 1/42; F28F 13/12

(52) U.S. Cl. ..... 165/177; 165/109.1; 165/176; 165/179

(58) Field of Search ..... 165/109.1, 170, 165/177, 179, 183, 148, 153, 176; 29/890.053; 138/38

(56) References Cited

U.S. PATENT DOCUMENTS 5,062,477 A * 11/1991 Kadle ..... 165/176 X
5,697,433 A * 12/1997 Kato ..... 165/177 X

FOREIGN PATENT DOCUMENTS

| | | | |
|---|---|---|---|
| GB | 2159265 | * 11/1985 | ..... 165/109.1 |
| JP | 1-174898 | * 7/1989 | ..... 165/153 |
| JP | 2-68500 | * 3/1990 | ..... 165/153 |
| JP | 4-32697 | * 2/1992 | ..... 165/153 |
| JP | 5-172485 | * 7/1993 | ..... 165/153 |

* cited by examiner

*Primary Examiner*—Leonard Leo
(74) *Attorney, Agent, or Firm*—Morgan & Finnegan, LLP

(57) ABSTRACT

The invention relates to a flat tube of a heat exchanger in heating installations or of a radiator of a motor vehicle which is folded from a flat sheet metal of aluminum or an aluminum alloy and across the respective flow of which spacers or the flat sides of the flat tube brazed or soldered to one another are distributed, which are designed as dents of the flat sides of the flat tube on one or both sides. According to the invention it is provided that in the same flow in addition to the spacers embossments freely projecting into the flow are distributed as turbulence-generating flow obstacles at least at one flat side of the flat tube.

14 Claims, 3 Drawing Sheets

FLAT TUBE OF A HEAT EXCHANGER IN HEATING INSTALLATIONS OR OF A RADIATOR OF A MOTOR VEHICLE

BACKGROUND OF THE INVENTION

The invention relates to a flat tube of a heat exchanger in heating installations or of a radiator of a motor vehicle with the features of the preamble of claim 1. Such a flat tube is known from the German Utility Model G 93 09 822.7, in particular FIGS. 6 to 7*b*.

In the known flat tube, the dents of at least one flat side of the flat tube are arranged such that on the one hand a mutual holding stabilization of the flat sides against bursting pressure is effected and on the other hand a desired generation of turbulences is achieved.

For the generation of turbulences, the spacers have to be arranged relatively closely to one another. This, however, results in a relatively marked mutual blocking of the flow resulting in a maximum turbulence in direct proximity to the spacers and a relatively low degree of flow turbulences therebetween. The high turbulence in the proximity to the spacers leads to a relatively high degree of erosion.

A multiplicity of types of dented spacers soldered or brazed to one another in flat tubes folded from sheet metal are also known otherwise (e.g. GB-2 223 091 A and DE 15 01 537 A).

BRIEF SUMMARY OF THE INVENTION

The object underlying the invention is to even out the generation of turbulences such that the danger of erosion is reduced at the same time maintaining a sufficient safety of the flat tube against bursting.

In a flat tube of a heat exchanger in heating installations or of radiator of a motor vehicle which is folded from a flat sheet metal of aluminum or an aluminum alloy and across the respective flow of which spacers of the flat sides of the flat tube are distributed, which are soldered or brazed to one another and designed as dents of the flat sides of the flat tube on one or both sides, this object is achieved by the characterized features there of.

Two alternative preferred arrangements of the spacers are possible here only arranged in a relatively low number. The spacers may be aligned centrally flushing longitudinally of the flow which is particularly convenient for rather narrow flows and the spacers are laterally staggered at opposite sides longitudinally of the flow which is for rather broad flows. Here, it is no longer necessary to distribute the spacers in a grid across the width of the respective flow as is done in the known flat tubes, but according to the former embodiment they can be optimally arranged fluidically even in only one line and according to the latter embodiment in two lines longitudinal of the flow one after the other and thus the risk of an erosion in particular at the side of the incoming flow can be further reduced. This is even more true if an embossment each is arranged preceding the spacer in the flow direction, so as to say as a bulwark.

In the special case of flat tubes of at least two flows, it is convenient with spacers being adjacent to the partition between the flows to surround the region not adjacent to the partition with a gross of embossments. In case of other spacers arranged at a distance to lateral partitions of an arbitrary number of flows, in particular also in case of one-flow flat tubes, the spacers can be surrounded all around by a group of embossments.

If the spacers are designed as elongated flow profiles, it is recommendable to intercalate at least one embossment between the spacers, but furthermore to arrange longitudinally of the flow profile at least in regions facing away from a partition between adjacent flows at least two embossments in the flow direction one after the other.

In general, a design having the embossments distributed in a point raster or the embossments are shaped like calotte shells has proved to be convenient for the arrangement and embodiment of the embossments.

The design of the spacers themselves is selected in the sense of the object of the invention to keep the erosion at the spacers as low as possible. In this respect, the oval central soldering or brazing joint itself only offers little resistance against erosion. In particular the funnel-shaped inflow leads to a flow deflection. This effect is favourably increased by the preferably provided dent, preferably in the funnel-shaped inflow region, but also in the funnel-shaped outflow region, due to the fact that the dents themselves take over the function of bulwarks.

BRIEF DESCRIPTION OF THE DRAWINGS

In the following, the invention will be described more in detail by means of schematic drawings with several embodiments, wherein.

DETAILED DESCRIPTION OF THE INVENTION

Figure 1:
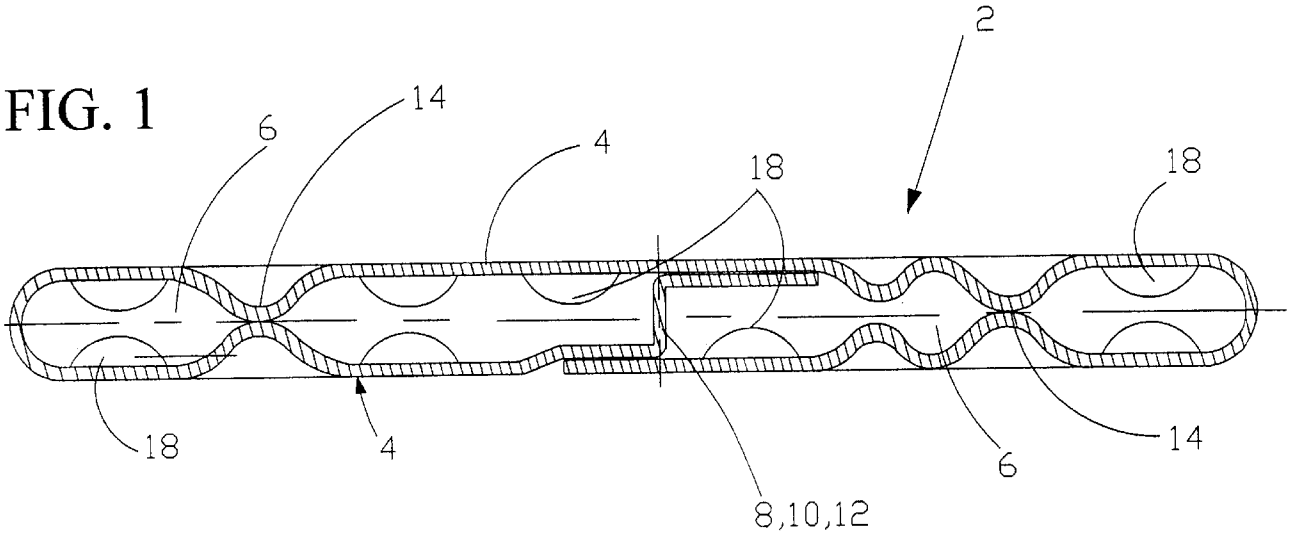
FIG. 1 shows a cross-section through a folded flat tube.
Figure 3:
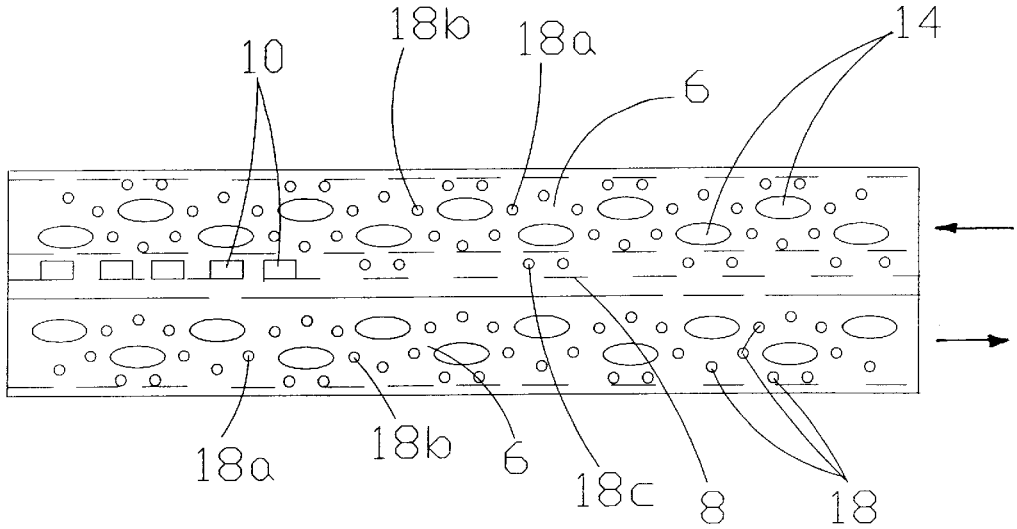

The flat tube according to FIG. 1 is folded from a sheet metal part of aluminum or an aluminum alloy in the method of manufacture and the embodiment according to DE-A1-195 48 495, in particular of FIG. 3 thereof.

Here, the flat tube 2 comprises two parallel flat sides 4 which pass over into one another at the two edges of the flat tube each in a rounded fashion. The flat tube has a double-flow design with internal flow ducts 6 which are separated from one another by a partition 8. A flow reverse is effected at an opening 10 between the two adjacent flows of the flow ducts 6 separated by the partition 8. This partition 8 is formed by a step 12 at a free sheet metal edge, which roughly has the shape of a Z, the central web of the Z forming the partition. The one side web of the Z here internally and flatly contacts the free end of the other free sheet metal edge, the internal side web of the Z flatly contacting the internal side of the broad side of the flat tube facing the free sheet metal edge. A mutual braze was effected in the region of this flat contact. The overlapping of the first mentioned side web of the Z-profile with the free sheet metal edge here is effected such that the broad side being the lower one in the drawing plane 4 has a plane design in that correspondingly only one overlapping step is formed having the thickness of approximately one sheet metal wall.

Figure 4:
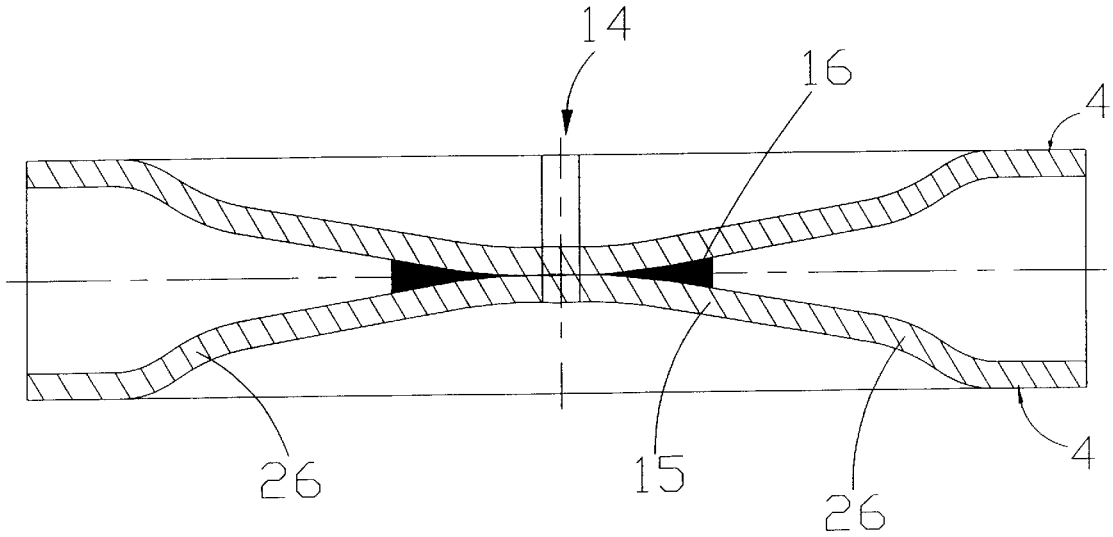
FIG. 4 shows a section in an enlarged scale in the flow direction perpendicular to the flat side of a flat tube according to FIG. 2 or FIG. 3 through a soldered or brazed spacer.
Figure 4A:
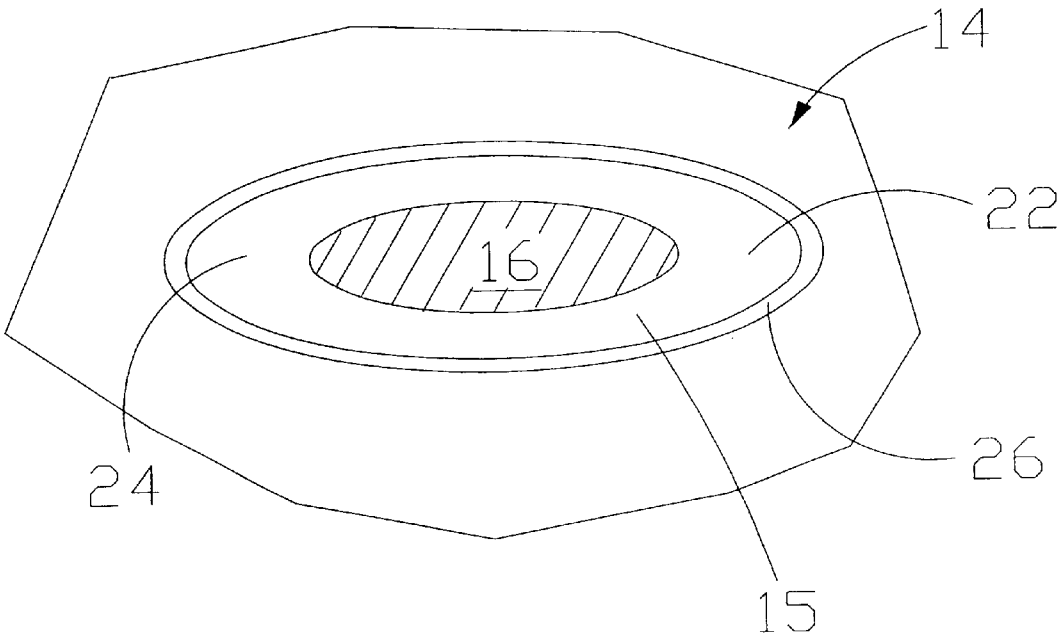
FIG. 4*a* shows a section in parallel to the flat sides through the central plane of the representation of FIG. 4.

In both flow ducts 6 the two facing flat sides 4 are mutually stabilized by spacers 14 which are in this case designed as dents at both sides of the flat sides 4, the design and the depth of their dents 15 being the same and which are rigidly connected to one another at their front sides by the groove 16 (cf. FIGS. 4 and 4*a*).

Figure 2:
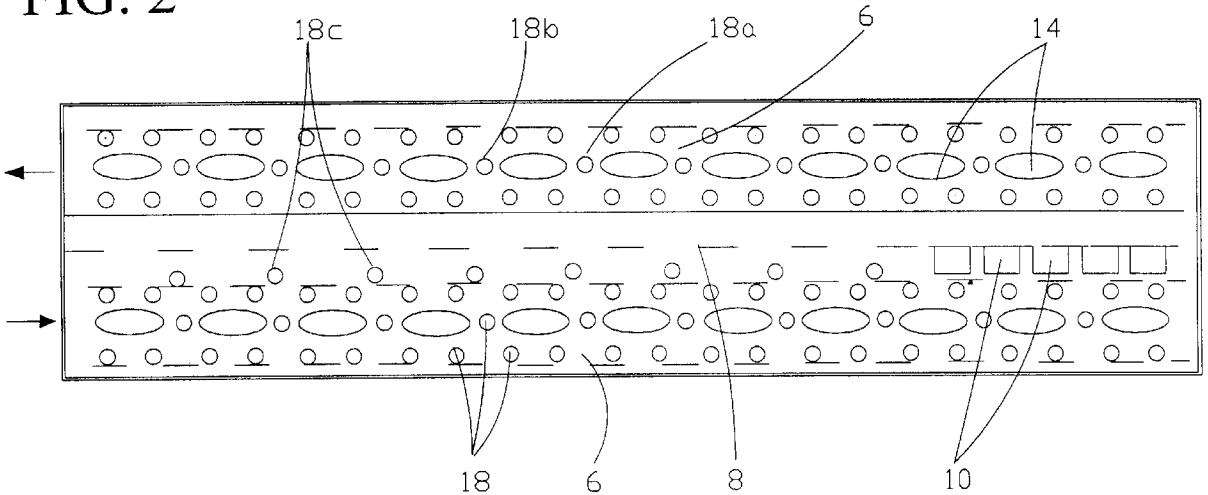
FIG. 2 and FIG. 3 show each a plan view of two different modifications of the flat side of the flat tube according to FIG. 1.

In the arrangement according to FIG. 2, the spacers 14 are aligned longitudinally of the flow of the respective flow duct 6 and centrally flush, while in the alternative arrangement according to FIG. 3 they are laterally staggered at opposite sides longitudinally of the flow.

Figure 5:
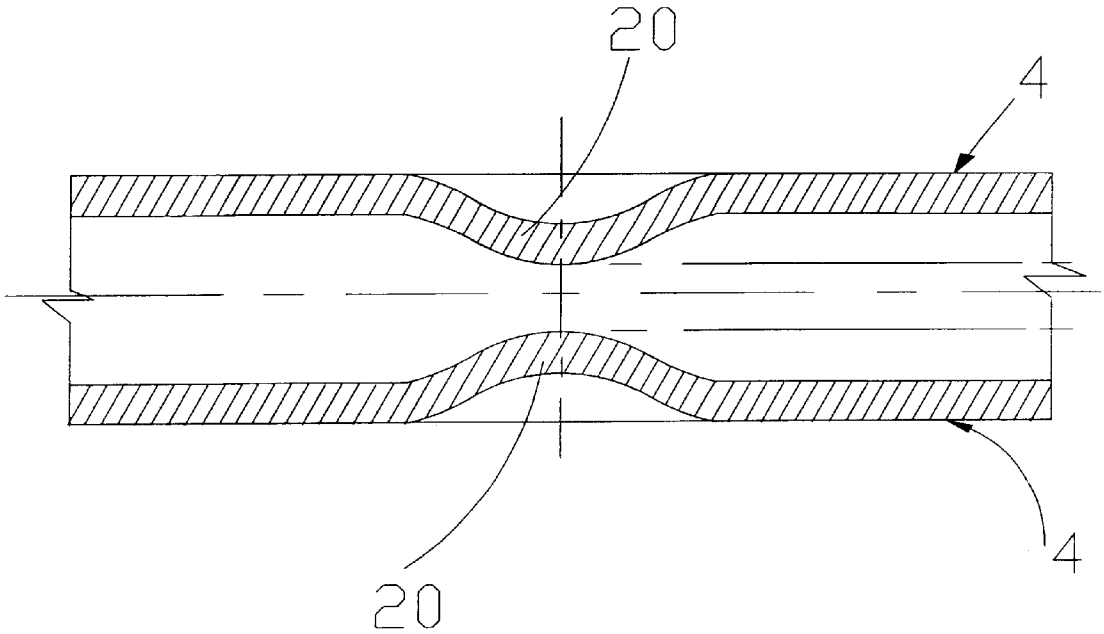
FIG. 5 shows in the same type of representation as in FIG. 4 a section through two facing embossments in a flat tube according to FIG. 2 or FIG. 3.

In addition to the dents 15, which form the spacers 14, furthermore in the same flow formed by the respective flow duct 6 in addition to the spacers 14 embossments 18 freely projecting into the flow are distributed at both flat sides 4 in a point raster and are shaped like calotte shells 20 according to FIG. 5, the calotte shells 20 in contrast to the dents 15 having mutual distances and being otherwise equally arranged, i.e. facing each other.

Especially, a group of the embossments 18 each is arranged surrounding the respective spacer 14 all around, one embossment 18*a* each being arranged in the flow direction ahead of the spacer 14. For symmetric reasons of the method of manufacture in case of a flow reverse of the two flows each spacer is then symmetrically followed by an embossment 18*b* each. Moreover, longitudinally of the flow direction at the two sides of each spacer at least two embossments 18 are provided each, such that the respective group is formed each by six embossments 18 including the two embossments 18*a* and 18*b*.

Furthermore, in the region of the partition 8, at least at one flat side 4, additional embossments 18*c* can be provided as can be seen from FIGS. 1 to 3.

The opening 10 in the partition is resolved according to the representation in FIGS. 2 and 3 into a plurality of rectangular openings, conveniently punch outs, in the partition.

As far as a spacer 14 is arranged so close to the partition 8 that there is no space left for an embossment 18 or that this does no longer make sense with respect to the flow, the group of six embossments 18 represented in the figures surrounding the spacer all around can also be reduced by the one embossment 18 close to the partition in a manner not shown.

From FIG. 4*a* it becomes clear that in the region of the respective spacer 14 the brazed or soldered joint in turn is a body with an oval or lens shape in the flow direction which in so far to a certain degree already has the character of a flow profile. Nevertheless, the braze or solder is essentially more sensible against erosion than the material of the sheet metal from which the flat tube 2 is folded. In order to further prevent an erosion due to a direct flow admission to the braze or solder 16, according to FIGS. 4 and 4*a* the spacer 14 is designed as a hydrodynamically optimized oblong flow body in the direction of the flow. In particular, the dents 15 on both sides forming the respective spacer 14 by being soldered or brazed at their apex regions by the solder or braze 16, are drawn in in a funnel shape (at 22) beyond the solder or braze in the flow direction on the inlet side and on the outlet side expanded in a funnel shape (at 24). Here, at the transition from the flat side 4 to the funnel-shaped body of the dent 15 there is each an indentation 26 at the inflow and at the outflow side.

What is claimed is:

1. A heat exchanger tube comprising a casing formed from a metallic blank rolled on itself, the blank defining two longitudinal ducts for counter-current flow of a fluid therein, wherein the blank comprises:

a plurality of funnel-shaped spacers projecting into the ducts, each spacer being joined in an oval apex region to a corresponding spacer on another side of the duct; and a plurality of embossments projecting into the ducts and being disposed in an opposing relationship, but are not joined to one another embossment.

2. The heat exchanger of claim 1, wherein the spacers are aligned near a longitudinal center line along the duct.

3. The heat exchanger of claim 2, wherein each spacer is surrounded by a group of embossments.

4. The heat exchanger of claim 1, wherein the spacers are laterally staggered at opposite sides along the duct.

5. The heat exchanger of claim 4, wherein each spacer is surrounded by a group of embossments.

6. The heat exchanger of claim 4, further comprising a longitudinal separating partition between the two ducts formed from the blank, and wherein at least some of the spacers are adjacent to the partition and are surrounded by a group of embossments facing away from the partition.

7. The heat exchanger of claim 1, wherein, in a flow direction, each spacer is preceded by an embossment.

8. The heat exchanger of claim 1, wherein the spacers are oblong in a flow direction.

9. The heat exchanger of claim 1, wherein the spacers have an indented shape in at least one of the inlet region and the outlet region.

10. The heat exchanger of claim 1, wherein the embossments are shaped like calotte shells.

11. The heat exchanger of claim 1, further comprising:

a longitudinal separating partition between the two ducts formed from the blank; and at least one communication aperture formed in the partition adapted to allow passage of fluid from one said duct to the other.

12. A heat exchanger tube comprising a casing consisting of a press-formed metallic blank rolled on itself, the blank defining two parallel, longitudinal ducts for counter-current flow of a fluid therein, wherein the blank comprises:

a plurality of longitudinally oblong-shaped spacers projecting into the ducts; and a plurality of embossments projecting into the ducts on at least one side of the blank, wherein the spacers are configured so that, in the casing, each spacer on one side of the casing is joined to one another spacer on another side of the casing, and wherein the embossments are disposed in an opposing relationship, but are not joined to one another, and wherein the spacers are, on a inlet side and on an outlet side in a flow direction, funnel shaped and wherein the spacers are joined to one another in an oval apex region.

13. The heat exchanger tube of claim 12, wherein the spacers have an indented shape in at least one of the inlet region and the outlet region.

14. A heat exchanger tube comprising:

a folded flat sheet metal blank of aluminum or an aluminum alloy, the blank having two flat sides and defining a fluid flow chamber;

a plurality of embossments freely projecting into the fluid flow chamber as turbulence-generating flow obstacles, the embossments being distributed on at least one flat side; and a plurality of hydrodynamically optimized and oblong-shaped spacers, the spacers being distributed on the flat sides, the spacers being formed by dents on both of the flat sides, which dents are on the inlet side and on the outlet side in the flow direction in a funnel shape, the spacers being soldered or brazed to one another in an oval apex region.

* * * * *